US011536479B2

(12) United States Patent
Mannfeld

(10) Patent No.: US 11,536,479 B2
(45) Date of Patent: Dec. 27, 2022

(54) UTILIZING HOME THERMOSTAT AS A WIRELESS GATEWAY FOR COMMUNICATING WITH HVAC EQUIPMENT

(71) Applicant: Carrier Corporation, Palm Beach Gardens, FL (US)

(72) Inventor: David Mannfeld, Carmel, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 34 days.

(21) Appl. No.: 16/760,232

(22) PCT Filed: Oct. 26, 2018

(86) PCT No.: PCT/US2018/057775
§ 371 (c)(1),
(2) Date: Apr. 29, 2020

(87) PCT Pub. No.: WO2019/089384
PCT Pub. Date: May 9, 2019

(65) Prior Publication Data

US 2020/0355389 A1 Nov. 12, 2020

Related U.S. Application Data

(60) Provisional application No. 62/578,668, filed on Oct. 30, 2017.

(51) Int. Cl.
*F24F 11/58* (2018.01)
*F24F 11/63* (2018.01)
(Continued)

(52) U.S. Cl.
CPC ..... *F24F 11/58* (2018.01); *F24F 11/52* (2018.01); *F24F 11/63* (2018.01); *G16Y 20/10* (2020.01); *G16Y 40/35* (2020.01)

(58) Field of Classification Search
CPC . F24F 11/58; F24F 11/63; F24F 11/52; G16Y 20/10
See application file for complete search history.

(56) References Cited

U.S. PATENT DOCUMENTS 7,188,002 B2 3/2007 Chapman, Jr. et al.
7,212,887 B2 5/2007 Shah et al.
(Continued)

FOREIGN PATENT DOCUMENTS

EP 1947543 A1 7/2008

OTHER PUBLICATIONS

International Search Report Application No. PCT/US2018/057775; dated Jan. 31, 2019; pp. 14.

*Primary Examiner* — Mohammad Ali
*Assistant Examiner* — Vincent W Chang
(74) *Attorney, Agent, or Firm* — Cantor Colburn LLP

(57) ABSTRACT

A heating, ventilation and air-conditioning (HVAC) system for a structure is provided. The HVAC system includes one or more of an outdoor unit disposed at an exterior of the structure and an indoor unit disposed at an interior of the structure. Various operations of the one or more of the outdoor and indoor units are controllable to maintain desired environmental conditions in the interior of the structure. At least one of the one or more of the outdoor and indoor units includes a wireless transceiver which is wirelessly communicative with an external entity.

7 Claims, 4 Drawing Sheets

(51) Int. Cl.

| | |
|---|---|
| ***F24F 11/52*** | (2018.01) |
| ***G16Y 20/10*** | (2020.01) |
| ***G16Y 40/35*** | (2020.01) |

(56) References Cited

U.S. PATENT DOCUMENTS

| | | | | |
|---|---|---|---|---|
| 7,296,426 | B2 | 11/2007 | Butler et al. | |
| 7,383,158 | B2 | 6/2008 | Krocker et al. | |
| 7,434,744 | B2 | 10/2008 | Garozzo et al. | |
| 7,469,550 | B2 | 12/2008 | Chapman, Jr. et al. | |
| 7,774,102 | B2 | 8/2010 | Butler et al. | |
| 7,775,452 | B2 | 8/2010 | Shah et al. | |
| 7,841,542 | B1 | 11/2010 | Rosen | |
| 8,543,244 | B2 | 9/2013 | Keeling et al. | |
| 8,594,850 | B1 | 11/2013 | Gourlay et al. | |
| 8,708,242 | B2 | 4/2014 | Conner et al. | |
| 8,950,688 | B2 | 2/2015 | Babich | |
| 9,285,802 | B2 | 3/2016 | Arensmeier | |
| 2005/0040943 | A1 | 2/2005 | Winick | |
| 2006/0247826 | A1 | 11/2006 | Green et al. | |
| 2007/0228183 | A1 | 10/2007 | Kennedy et al. | |
| 2012/0067561 | A1 | 3/2012 | Bergman et al. | |
| 2013/0334326 | A1 | 12/2013 | Shan | |
| 2014/0151456 | A1 | 6/2014 | McCurmin et al. | |
| 2014/0228983 | A1 | 8/2014 | Groskreutz et al. | |
| 2015/0041551 | A1 | 2/2015 | Tessier et al. | |
| 2015/0276238 | A1 | 10/2015 | Matsuoka et al. | |
| 2016/0040903 | A1 | 2/2016 | Emmons et al. | |
| 2016/0021842 | A1 | 7/2016 | Gokhale et al. | |
| 2016/0209068 | A1* | 7/2016 | Castillo | H04W 4/80 |
| 2016/0209074 | A1* | 7/2016 | Ito | F04D 27/001 |
| 2016/0217674 | A1 | 7/2016 | Stewart et al. | |
| 2017/0284691 | A1* | 10/2017 | Sinha | F24F 11/62 |
| 2018/0031266 | A1* | 2/2018 | Atchison | F24F 11/30 |
| 2018/0373401 | A1* | 12/2018 | Khiani | H04L 67/125 |
| 2019/0082240 | A1* | 3/2019 | Li | H04Q 9/00 |
| 2021/0190358 | A1* | 6/2021 | Shimamura | F24F 11/54 |

* cited by examiner

UTILIZING HOME THERMOSTAT AS A WIRELESS GATEWAY FOR COMMUNICATING WITH HVAC EQUIPMENT

CROSS-REFERENCE TO RELATED APPLICATIONS

This application is a National Phase of PCT Application No. PCT/US2018/057775 filed Oct. 26, 2018 which claims the benefit of priority to Provisional Application No. 62/578,668 filed Oct. 30, 2017, the disclosure of which is incorporated herein by reference in its entirety.

BACKGROUND

The following description relates to home thermostats and, more specifically, to a utilization of a home thermostat as a wireless gateway for reprogramming and accessing diagnostic data from heating, ventilation and air conditioning (HVAC) equipment.

HVAC is the technology of indoor and vehicular environmental comfort and is an important part of residential, industrial and commercial structures. The heating process in HVAC systems provides for increases in indoor temperatures while the air conditioning process provides for decreases in indoor temperatures. The ventilation processes involves exchanges or replacements of air in a space to thus provide for high indoor air quality with temperature control, oxygen replenishment and removal of moisture, odors, smoke, heat, dust, airborne bacteria, carbon dioxide and other gases. Ventilation includes both the exchange of indoor and outdoor air as well as the circulation of air within a building.

Home-based HVAC systems typically include an outdoor unit, an indoor unit, a thermostat and one or more sensors in some cases. The thermostat is usually accessible to the homeowner who uses the thermostat to set a desired temperature for an indoor space in a home. The thermostat then operates the outdoor and indoor units so as to achieve that desired temperature in a manner that also reduces costs and energy usage as much as possible. To this end, if the temperature in the indoor space is lower than the desired temperature by a predetermined degree, the thermostat will command the outdoor and indoor units to pump heated air into the indoor space so as to raise the temperature of the indoor space beyond the desired temperature by a predetermined degree. On the other hand, if the temperature in the indoor space is higher than the desired temperature by a predetermined degree, the thermostat will command the outdoor and indoor units to pump cool air into the indoor space so as to lower the temperature of the indoor space beyond the desired temperature by a predetermined degree.

BRIEF DESCRIPTION

According to an aspect of the disclosure, a heating, ventilation and air-conditioning (HVAC) system for a structure is provided. The HVAC system includes one or more of an outdoor unit disposed at an exterior of the structure and an indoor unit disposed at an interior of the structure. Various operations of the one or more of the outdoor and indoor units are controllable to maintain desired environmental conditions in the interior of the structure. At least one of the one or more of the outdoor and indoor units includes a wireless transceiver which is wirelessly communicative with an external entity.

In accordance with additional or alternative embodiments, the at least one of the one or more of the outdoor and indoor units further includes a processing element configured to control equipment operations in accordance with control software and to generate and store diagnostic information.

In accordance with additional or alternative embodiments, the control software is updateable via wireless communications between the processing element and the external entity.

In accordance with additional or alternative embodiments, the diagnostic information is accessible via wireless communications between the processing element and the external entity.

In accordance with additional or alternative embodiments, the external entity includes at least one of a Cloud computing element and a portable computing device.

In accordance with additional or alternative embodiments, one or more sensors are distributed throughout the interior of the structure to sense environmental conditions therein.

In accordance with additional or alternative embodiments, network repeaters are distributed to facilitate wireless communications between the wireless transceiver and the external entity.

According to another aspect of the disclosure, a heating, ventilation and air-conditioning (HVAC) system for a structure is provided. The HVAC system includes one or more of an outdoor unit disposed at an exterior of the structure and an indoor unit disposed at an interior of the structure. The HVAC system further includes a thermostat. The thermostat is configured to control various operations of the one or more of the outdoor and indoor units to maintain desired environmental conditions in the interior of the structure. At least one of the one or more of the outdoor and indoor units includes a wireless transceiver. The thermostat is wirelessly communicative with an external entity and the at least one of the one or more of the outdoor and indoor units.

In accordance with additional or alternative embodiments, one or more sensors are distributed throughout the interior of the structure to sense environmental conditions therein.

In accordance with additional or alternative embodiments, network repeaters are distributed to facilitate wireless communications between the thermostat, the external entity and the at least one of the one or more of the outdoor and indoor units.

In accordance with additional or alternative embodiments, the at least one of the one or more of the outdoor and indoor units further includes a processing element configured to control equipment operations in accordance with control software and to generate and store diagnostic information. The control software is updateable and the diagnostic information is accessible via wireless communications between the processing element, the thermostat and the external entity.

In accordance with additional or alternative embodiments, the external entity includes at least one of a Cloud computing element and a portable computing device.

In accordance with additional or alternative embodiments, wherein the HVAC system includes both of the outdoor and indoor units and each of the outdoor and indoor units includes a wireless transceiver.

In accordance with additional or alternative embodiments, one or more sensors are distributed throughout the interior of the structure to sense environmental conditions therein.

In accordance with additional or alternative embodiments, network repeaters are distributed to facilitate wireless communications between the thermostat, the external entity and the outdoor and indoor units.

In accordance with additional or alternative embodiments, the outdoor unit further includes a first processing element configured to control operations of equipment of the outdoor unit in accordance with first control software and to generate and store first diagnostic information and the indoor unit further includes a second processing element configured to control operations of equipment of the indoor unit in accordance with second control software and to generate and store second diagnostic information. The first and second control software is updateable and the first and second diagnostic information is accessible via wireless communications between the first and second processing elements, the thermostat and the external entity.

In accordance with additional or alternative embodiments, the external entity includes at least one of a Cloud computing element and a portable computing device.

According to another aspect of the disclosure, a method of operating a heating, ventilation and air-conditioning (HVAC) system for a structure is provided. The method includes establishing wireless communications with at least one of a thermostat of the HVAC system and an external entity and with at least one of an outdoor unit and an indoor unit of the HVAC system. The method further includes at least one of updating control software of the at least one of the outdoor and indoor units via the wireless communications and accessing diagnostic information of the at least one of the outdoor and indoor units via the wireless communication.

In accordance with additional or alternative embodiments, the establishing of the wireless communications includes providing the thermostat of the HVAC system as a gateway between the external entity and the at least one of the outdoor and indoor units.

In accordance with additional or alternative embodiments, the external entity includes at least one of a Cloud computing element and a portable computing device.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, a heating, ventilation and air-conditioning (HVAC) system for a structure is provided. The HVAC system includes an outdoor unit disposed at an exterior of the structure and an indoor unit disposed at an interior of the structure. Various operations of the outdoor and indoor units are controllable to maintain desired environmental conditions in the interior of the structure and at least one of the outdoor and indoor units being wirelessly communicative with an external entity.

Figure 1:
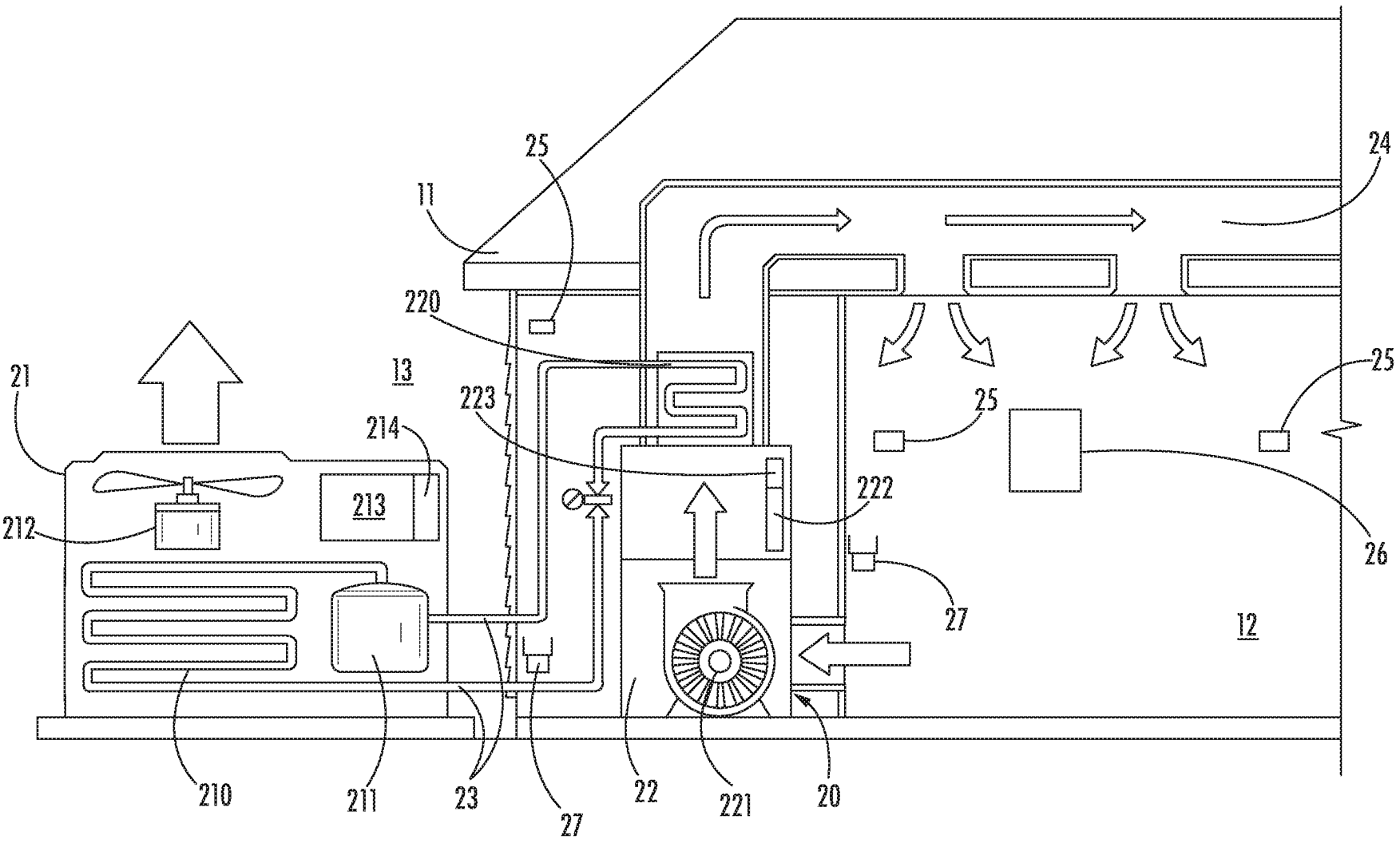
FIG. 1 is a perspective view of a structure in which a heating, ventilation and air-conditioning (HVAC) system is deployed in accordance with embodiments.
Figure 3:
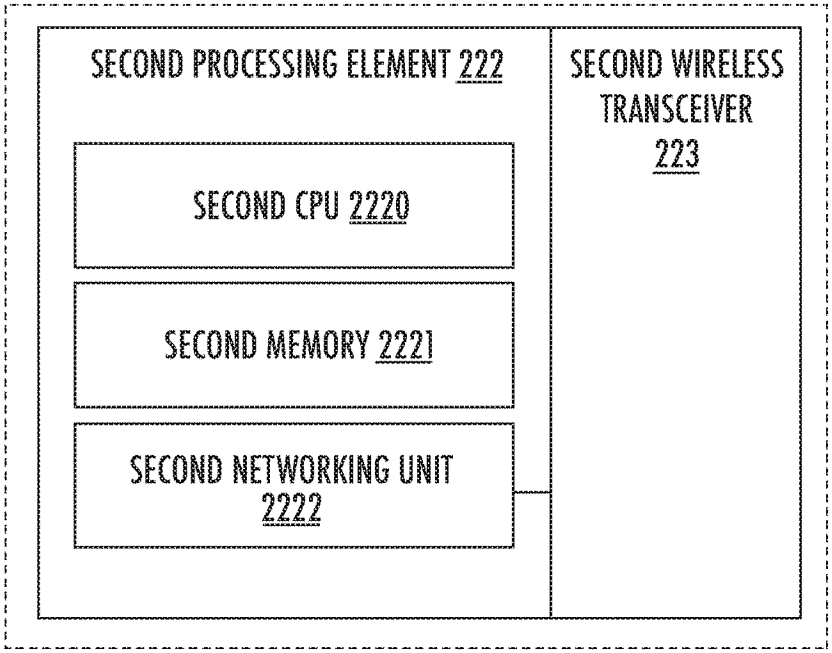
FIG. 3 is a schematic diagram of a processing element of the indoor unit of the HVAC system of FIG. 1.
Figure 2:
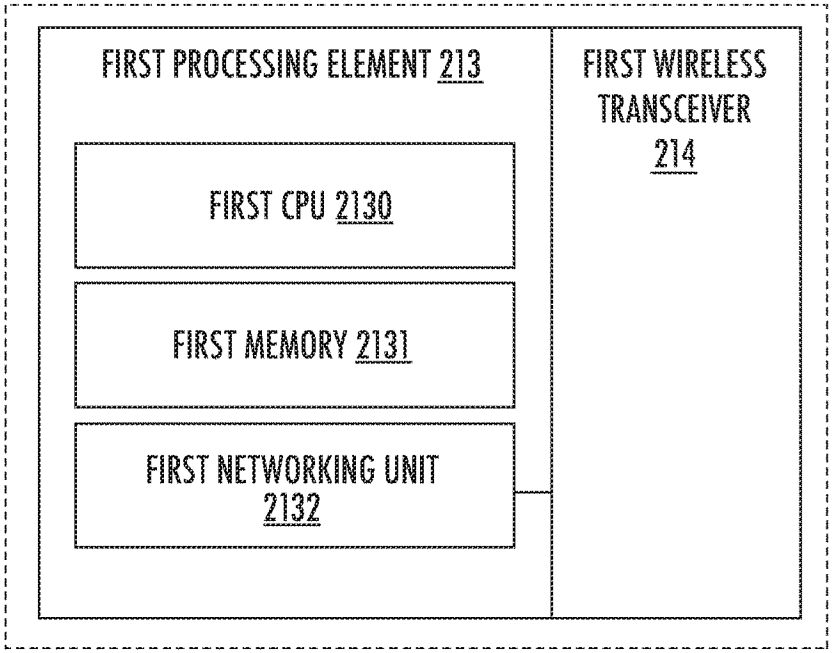
FIG. 2 is a schematic diagram of a processing element of the outdoor unit of the HVAC system of FIG. 1.

With reference to FIGS. 1-3, a structure 10 is provided and may be configured as a residence, an industrial building or a commercial building. For purposes of clarity and brevity, however, the following description will relate to the case where the structure 10 is configured as a single-family residence. The structure 10 thus includes a structural body 11 which defines an interior 12 and separates the interior 12 from an exterior 13. The interior 12 may be further divided into multiple rooms and areas for various purposes.

The structure 10 includes an HVAC system 20 disposed and configured to control environmental conditions within the interior 12. The HVAC system 20 includes one or more of an outdoor unit 21 and an indoor unit 22. The outdoor unit 21 is disposed at the exterior 13 of the structural body 11 and the indoor unit 22 is disposed in the interior 12.

As shown in FIGS. 1 and 2, the outdoor unit 21 includes a condenser coil 210, a compressor 211, a fan 212 and, in some cases, a first processing element 213 and a first wireless transceiver 214. The first processing element 213 may include a first central processing unit (CPU) 2130, a first memory 2131 and a first networking unit 2132 by which the first CPU 2130 is communicative with the first wireless transceiver 214. The first memory 2131 has executable instructions stored thereon for execution by the first CPU 2130 such that the first CPU 2130 performs the methods, algorithms and processes described herein. The first wireless transceiver 214 may be provided within a housing of the outdoor unit 21 such that the first wireless transceiver 214 is generally protected from environmental conditions of the exterior 13 and may include at least an antenna which is capable of signal reception and transmission through the housing.

As shown in FIGS. 1 and 3, the indoor unit 22 includes an indoor coil 220, a furnace 221 and, in some cases, a second processing element 222 and a second wireless transceiver 223. The second processing element 222 may include a second central processing unit (CPU) 2220, a second memory 2221 and a second networking unit 2222 by which the second CPU 2220 is communicative with the second wireless transceiver 223. The second memory 2221 has executable instructions stored thereon for execution by the second CPU 2220 such that the second CPU 2220 performs the methods, algorithms and processes described herein. The second wireless transceiver 223 may be provided within a housing of the indoor unit 22 such that the second wireless transceiver 223 is generally protected from environmental conditions within the interior 12 and may include at least an antenna which is capable of signal reception and transmission through the housing.

Refrigeration lines 23 are provided to connect the outdoor unit 21 with the indoor unit 22 and ducts 24 are provided throughout the interior 12 such that heated or cool air can be transported from the indoor unit 22 to the various areas in the interior 12.

In some cases, the components of the outdoor unit 21 and the indoor unit 22 may be included in a single unit that can be disposed at the exterior 13 of the structural body 11 or in the interior 12. For example, the components of the indoor unit 22 may be included in the outdoor unit 21 and disposed at the exterior 13. Conversely, the components of the outdoor unit 21 may be included in the indoor unit 22 and disposed in the interior 12. Still other embodiments exist in which the components of the outdoor and indoor units 21 and 22 are included in a single device which is partially disposed at the exterior 13 and partially disposed in the interior 12 (e.g., a window air-conditioning unit).

The HVAC system 20 may further include one or more sensors 25, such as temperature sensors, that are distributed throughout the interior 12 and possibility at the exterior 13 and a thermostat 26. The thermostat 26 is generally accessible to an individual and is configured to control various operations of the outdoor and indoor units 21 and 22 to maintain desired environmental conditions in the interior 12 in accordance with at least readings of the one or more sensors 25 and with user inputted commands. The thermostat 26 is wirelessly communicative with an external entity 30 (see FIG. 4), such as a Cloud computing element 31 or a portable computing device 32 (see FIG. 4), the one or more sensors 25 and at least one of the outdoor and indoor units 21 and 22.

In accordance with further embodiments, the HVAC system 20 may also include one or more network repeaters 27. Such network repeaters 27 may be distributed throughout the interior 12 and possibly the exterior 13 so as to facilitate wireless communications.

It is to be understood that the HVAC system 20 need not include the one or more sensors 25 or the thermostat 26 in which case the at least one of the outdoor and indoor units 21 and 22 may be directly wirelessly communicative with the external entity 30. The following description will relate, however, to the cases in which the HVAC system 20 includes the one or more sensors 25, the thermostat 26 and the network repeaters 27. The following description will also relate to the cases in which the thermostat is wirelessly communicative with both the outdoor unit 21 and the indoor unit 22. This is being done for clarity and brevity and is not intended to otherwise limit the scope of the application as a whole.

The thermostat 26 may have the capability to establish and maintain wireless connectivity over various networks (e.g., Wi-Fi, BlueTooth™, Z-Wave, Zigbee, etc.). The thermostat 26 can therefore be connected to a homeowner's Wi-Fi network and the Internet. This allows the thermostat 26 to have additional features and capabilities including, but not limited to, being remotely controllable by a user using the portable computing device 32 (see FIG. 4) (e.g., a mobile phone, a tablet, a laptop, etc.). The thermostat 26 may also have a second private wireless communication link operative along any type of network with the outdoor and indoor units 21 and 22 being communicative with the thermostat 26 on this or any other link. In addition, the link between the outdoor and indoor units 21 and 22 and the thermostat 26 could be developed to automatically pair and connect. In any case, the thermostat 26 effectively acts as an Internet gateway for both reprogramming and accessing diagnostics of each of the outdoor and indoor units 21 and 22.

Figure 4:
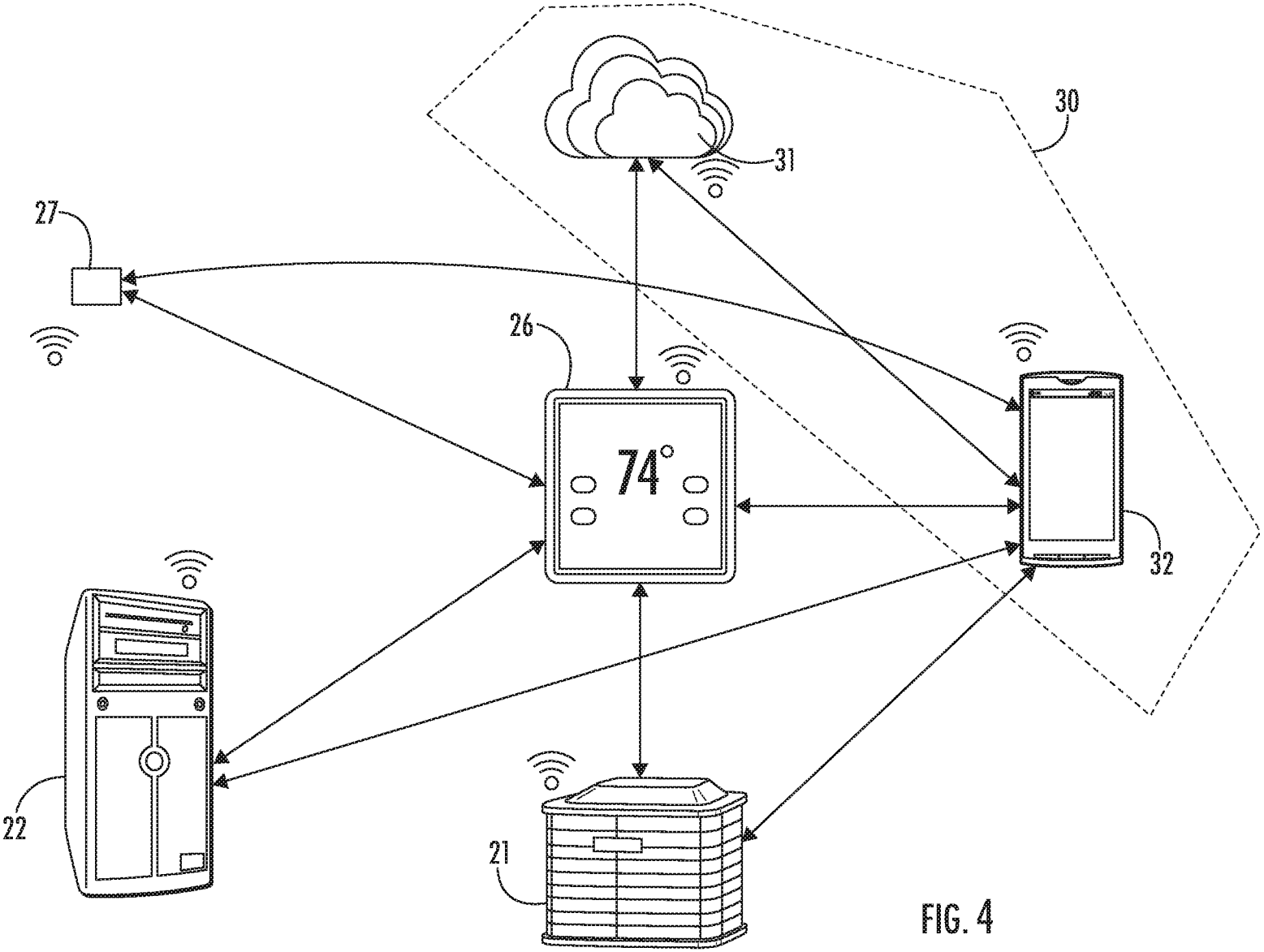
FIG. 4 is a schematic diagram of wireless communications established for the HVAC system of FIG. 1 in accordance with embodiments.

Thus, with reference to FIG. 4, any type of wireless communications may be established and maintained between the thermostat 26, the one or more sensors 25, the outdoor unit 21, the indoor unit 22 and the external entity 30 (i.e., the Cloud computing element 31 or the portable computing device 32) and/or between the portable computing device 32 and the outdoor and indoor units 21 and 22.

In accordance with embodiments, the executable instructions of the first memory 2131 may include control software by which the first CPU 2130 controls operations of the equipment of the outdoor unit 21 as well as instructions for generating and storing diagnostic information on storage units of the first memory 2131. This control software is updateable via the wireless communications by automatic or manual command received from the Cloud computing element 31 or the portable computing device 21 directly or through the thermostat 26. In addition, the stored diagnostic information may be accessible via the wireless communications to the Cloud computing element 31 or the portable computing device 32 directly or through the thermostat 26.

In accordance with embodiments, the executable instructions of the second memory 2221 may include control software by which the second CPU 2220 controls operations of the equipment of the indoor unit 22 as well as instructions for generating and storing diagnostic information on storage units of the second memory 2221. This control software is updateable via the wireless communications by automatic or manual command received from the Cloud computing element 31 or the portable computing device 21 directly or through the thermostat 26. In addition, the stored diagnostic information may be accessible via the wireless communications to the Cloud computing element 31 or the portable computing device 32 directly or through the thermostat 26.

Figure 5:
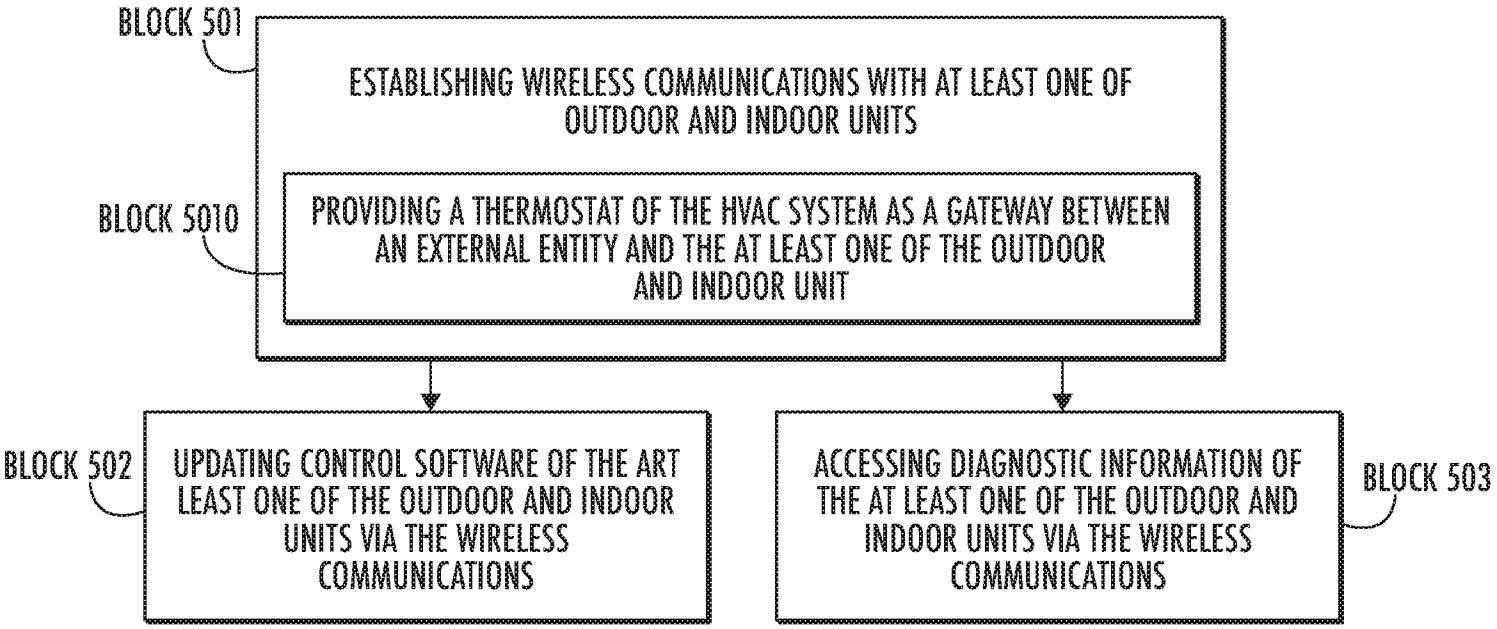
FIG. 5 is a flow diagram illustrating a method of operating an HVAC system in accordance with embodiments.

With reference to FIG. 5, a method of operating an HVAC system is provided. As shown in FIG. 5, the method includes establishing wireless communications with at least one of outdoor and indoor units of the HVAC system (block 501) by, for example, providing a thermostat of the HVAC system as a gateway between an external entity (e.g., a Cloud computing element or a portable computing device) and the at least one of the outdoor and indoor units (block 5010). The method further includes at least one of updating control software of the at least one of the outdoor and indoor units via the wireless communications (block 502) and accessing diagnostic information of the at least one of the outdoor and indoor units via the wireless communications (block 503).

The features described herein allow for over-the-air updates of software in outdoor and indoor HVAC units without the necessity of running additional wires from the thermostat to the outdoor and indoor units. The features also overcome the issue of the homeowner potentially not connecting a wireless enabled device to their home network.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A heating, ventilation and air-conditioning (HVAC) system for a structure, comprising one or more of:

an outdoor unit disposed at an exterior of the structure;

an indoor unit disposed at an interior of the structure;

a thermostat, which is wirelessly communicative with a cloud computing element and with each of the outdoor and indoor units, the thermostat acting as a gateway between the cloud computing element and the outdoor and indoor units; and wherein:

various operations of each of the outdoor and indoor units are controllable to maintain desired environmental conditions in the interior of the structure, and the outdoor and indoor units each comprising:

a processing element configured to control equipment operations in accordance with control software and to generate and store diagnostic information; and a wireless transceiver, which is wirelessly communicative with the thermostat and with the cloud computing element, by which the control software is updated and the diagnostic information is accessed via direct wireless communications between the processing element and the cloud computing element and via indirect wireless communications between the processing element, the thermostat and the cloud computing element in response to automatic commands from the cloud computing element to update the control software and to access the diagnostic information.

2. The HVAC system according to claim 1, further comprising one or more sensors distributed throughout the interior of the structure to sense environmental conditions therein.

3. The HVAC system according to claim 1, further comprising network repeaters distributed to facilitate wireless communications between the wireless transceiver and the cloud computing element.

4. A heating, ventilation and air-conditioning (HVAC) system for a structure, comprising one or more of:

an outdoor unit disposed at an exterior of the structure;

an indoor unit disposed at an interior of the structure, the HVAC system further comprising a thermostat configured to control various operations of the outdoor and indoor units to maintain desired environmental conditions in the interior of the structure, wherein:

each of the outdoor and indoor units comprises a wireless transceiver which is communicative with a cloud computing element, the thermostat is wirelessly communicative with the cloud computing element and with the wireless transceiver of each of the outdoor and indoor units, the outdoor unit further comprises a first processing element configured to control equipment operations in accordance with first control software and to generate and store first diagnostic information wherein the first control software is updateable and the first diagnostic information is accessible via direct wireless communications between the first processing element and the cloud computing element and via indirect wireless communications between the first processing element, the thermostat and the cloud computing element in response to automatic commands from the cloud computing element to update the control software and to access the diagnostic information, and the indoor unit further comprises a second processing element configured to control equipment operations in accordance with second control software and to generate and store second diagnostic information wherein the second control software is updateable and the second diagnostic information is accessible via direct wireless communications between the second processing element and the cloud computing element and via indirect wireless communications between the second processing element, the thermostat and cloud computing element in response to automatic commands from the cloud computing element to update the control software and to access the diagnostic information.

5. The HVAC system according to claim 4, further comprising one or more sensors distributed throughout the interior of the structure to sense environmental conditions therein.

6. The HVAC system according to claim 4, further comprising network repeaters distributed to facilitate wireless communications between the thermostat, the cloud computing element and the at least one of the one or more of the outdoor and indoor units.

7. A method of operating a heating, ventilation and air-conditioning (HVAC) system for a structure, which comprises a thermostat, an outdoor unit and an indoor unit, the method comprising:

providing the thermostat as a gateway between the cloud computing element and the outdoor and indoor units;

establishing direct wireless communications between a cloud computing element and the outdoor unit;

establishing direct wireless communications between the cloud computing element and the indoor unit;

establishing indirect wireless communications between the thermostat, the cloud computing element and the outdoor unit;

establishing indirect wireless communications between the thermostat, the cloud computing element and the indoor unit;

updating control software and accessing diagnostic information of the outdoor unit via the direct and the indirect wireless communications in response to automatic commands from the cloud computing element to update the control software and to access the diagnostic information of the outdoor unit; and updating control software and accessing diagnostic information of the indoor unit via the direct and the indirect wireless communications in response to automatic commands from the cloud computing element to update the control software and to access the diagnostic information of the indoor unit.

* * * * *